US006932642B2

(12) United States Patent
Beer et al.

(10) Patent No.: US 6,932,642 B2
(45) Date of Patent: Aug. 23, 2005

(54) LOW INSERTION FORCE CONNECTOR

(75) Inventors: Robert C. Beer, Noblesville, IN (US); Brad T. Hanauer, Muncie, IN (US); Scott A Keener, Columbia, MD (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/840,519

(22) Filed: May 6, 2004

(65) Prior Publication Data

US 2005/0009398 A1 Jan. 13, 2005

Related U.S. Application Data

(60) Provisional application No. 60/468,367, filed on May 6, 2003.

(51) Int. Cl.[7] ..... H01R 9/07
(52) U.S. Cl. ..... 439/495
(58) Field of Search ..... 439/495, 496, 439/260, 494, 259, 630

(56) References Cited

U.S. PATENT DOCUMENTS

| | | | | | |
|---|---|---|---|---|---|
| 4,477,137 | A | | 10/1984 | Ayer | |
| 4,718,859 | A | | 1/1988 | Ayer | |
| 5,145,381 | A | | 9/1992 | Volz | |
| 5,281,160 | A | | 1/1994 | Walkup | |
| 5,639,260 | A | * | 6/1997 | McHugh | 439/495 |
| 5,688,143 | A | | 11/1997 | McHugh | |
| 5,899,756 | A | | 5/1999 | Suzuki | |
| 6,022,242 | A | | 2/2000 | Suzuki | |
| 6,254,406 | B1 | * | 7/2001 | Chiu et al. | 439/142 |
| 6,267,620 | B1 | * | 7/2001 | Ma | 439/495 |
| 6,280,240 | B1 | | 8/2001 | Chang | |
| 6,319,052 | B1 | * | 11/2001 | Chang | 439/495 |
| 6,431,907 | B1 | * | 8/2002 | Ma | 439/495 |
| 6,551,128 | B2 | * | 4/2003 | Asai | 439/495 |
| 6,572,398 | B2 | * | 6/2003 | Onuma | 439/422 |
| 2002/0081884 | A1 | * | 6/2002 | Asai | 439/260 |

* cited by examiner

*Primary Examiner*—Ross Gushi
*Assistant Examiner*—Phuongchi Nguyen
(74) *Attorney, Agent, or Firm*—David P. Wood

(57) ABSTRACT

The present invention includes a low insertion force connector assembly capable of providing an electrical interface to a circuit board. The connector assembly includes a housing and electrically conductive terminals mounted in the housing. The connector assembly further includes slide and wedge members which are inserted into the housing along with a connective end portion of a flexible flat cable pressing exposed conductors on the flexible flat cable against terminal contact arms.

24 Claims, 8 Drawing Sheets

LOW INSERTION FORCE CONNECTOR

RELATED APPLICATIONS

This application claims benefit of priority from U.S. Provisional Patent Application No. 60/468,367, which was filed May 6, 2003, and which is hereby incorporated by reference.

TECHNICAL FIELD

The present invention relates to electrical connectors for flat cables, and more particularly relates to a connection system incorporating a low insertion force connector and a flexible flat cable.

BACKGROUND OF THE INVENTION

Flexible flat cables, which may include and which may otherwise be known as flexible circuits or flexible printed circuits, typically comprise flat flexible conductors, usually copper, that are arranged side by side on a thin, flexible sheet or film of plastic insulation such as polyethylene. The flexible conductors may also be embedded in the plastic insulator or sandwiched between two flexible sheets of plastic insulation that are bonded together.

Low insertion force (LIF) and zero insertion force (ZIF) connectors are known in the field for use in connecting printed circuit boards to flexible flat cables. One aspect of the known LIF and ZIF connectors is that a flexible flat cable having exposed conductors is inserted into a LIF or ZIF connector that is soldered or otherwise affixed to a printed circuit board. However, this presents hazards during assembly in applications where a powered flexible circuit must be attached to a circuit board. In one such application, a lithium battery is used to provide power. The battery is attached to an electronic control circuit board to monitor and control voltage. The use of known LIF and ZIF connectors exposes assembly operators to uncovered powered circuit traces when assembling the connection.

Known LIF and ZIF connectors typically lack positive locks to verify full insertion of the flexible cable to the circuit and secondary locks to improve assembly reliability. In many known LIF and ZIF connectors it is difficult to accurately align the flexible cable to the connector or circuit board resulting in shorting across circuits. In addition, many ZIF designs require the use of a separate wedge or secondary cam to apply a normal force to a terminal contacting a conductive trace on a flexible circuit. The use of an extra step to insert a wedge causes misalignments.

SUMMARY OF THE INVENTION

In accordance with an exemplary form of the present invention a connector assembly is provided offering advantages and alternatives over the prior art in that it is a low insertion force connector designed to assure alignment between a flexible flat cable and the connector, provide a positive lock to assure complete insertion, and provide protection from exposed circuit traces during assembly of the flexible flat cable to the connector.

In an exemplary embodiment of the present invention, the low insertion force connector includes an insulative housing, a plurality of terminals mounted in the housing, a flexible flat cable member, a slide member, a wedge member, and a secondary lock member.

In accordance with an exemplary form of the present invention, the insulative housing defines a cavity for receiving a connecting end portion of the flexible flat cable member secured between the slide member and wedge member. The terminals are mounted in the housing such that a first end portion extends outside the housing and a second end portion extends into the receiving cavity forming generally parallel rows of first and second contact arms. The connecting end portion of the flexible flat cable has exposed conductors on one side. The connecting end portion is secured between the slide member and the wedge member. The slide member has a cable contact side for contacting a first side of the connecting end portion of the flexible flat cable. A plurality of axially extending first contact arm receiving slots are formed in the cable contact side extending to a mating face of the slide member. Each slot is for receiving the first contact arm of one of the terminals when the slide member along with the wedge member and flexible flat cable are connected to the housing. The slots and exposed conductors are positioned to enable the terminals to electrically contact the exposed conductors when the slide member along with the wedge member and flexible flat cable are connected to the housing.

An exemplary form of the present invention incorporates a number of alignment features. These features enable an operator to easily and reliably assemble the connector assembly.

In an exemplary form of the present invention, the slide member, the wedge member, and the flexible flat cable member are pre-assembled into a flat cable assembly. The slide member includes a deflectable locking tab and the housing includes a cooperating locking tab socket for releasably retaining the flat cable assembly in the cavity formed in the housing. An exemplary form of the present invention further includes a secondary lock member that is inserted into the locking tab maintaining the locking tab in a locked position and preventing disconnection of the flexible flat cable from the terminals. The locking tab, also known as a Connector Position Assurance, can be pre-assembled to the flat cable assembly, enhancing the insertion process in the final application. The locking tab and socket mechanism of the present invention are capable of providing tactile, visual, and audible feedback indicating that the flat cable assembly is connected and locked into the header cavity.

The interaction of the terminals with the slide member and wedge member during assembly eliminates the need for a secondary cam to apply a normal force to the terminal eliminating misalignments caused by an additional cam insertion step.

These and other features and advantages of the present invention will become apparent from the following brief description of the drawings, detailed description, and appended drawings.

BRIEF DESCRIPTION OF THE DRAWINGS

The present invention will now be described, by way of example, with reference to the accompanying drawings, in which.

DETAILED DESCRIPTION OF THE INVENTION

Figure 1:
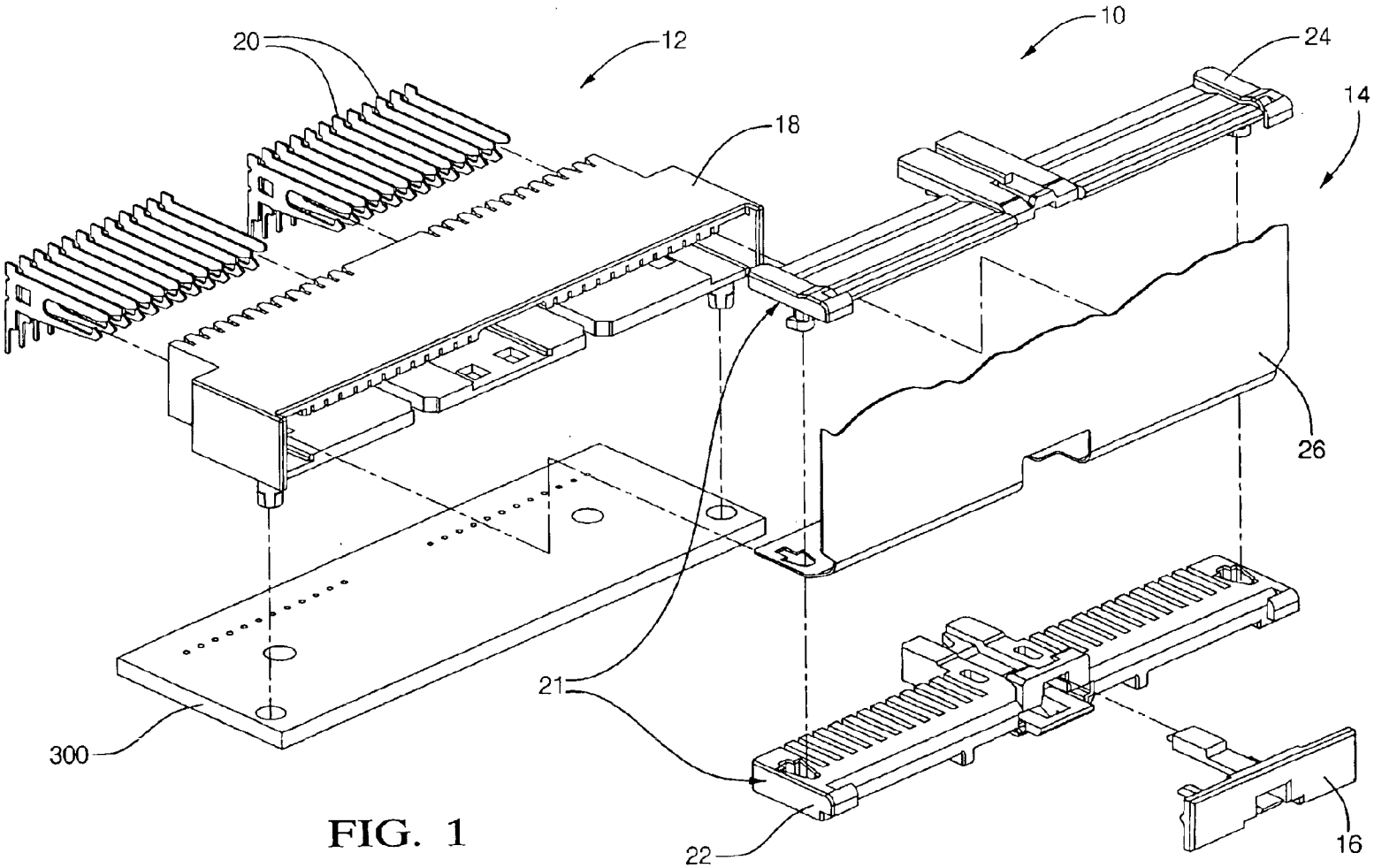
FIG. 1 is a perspective view of a connector assembly according to the present invention.

Referring to the figures wherein like numerals refer to like elements throughout the several views, FIG. 1 illustrates an exemplary embodiment of connector assembly 10 of the present invention including first connector or header assembly 12, flat cable assembly 14, and secondary lock member 16. Header assembly 12 includes insulative housing 18 and a plurality of conductive terminals 20. Flat cable assembly 14 includes second connector 21 and flexible flat cable 26. Second connector 21 includes insulative first connector housing half or slide member 22 and insulative second connector housing half or wedge member 24.

Figure 2:
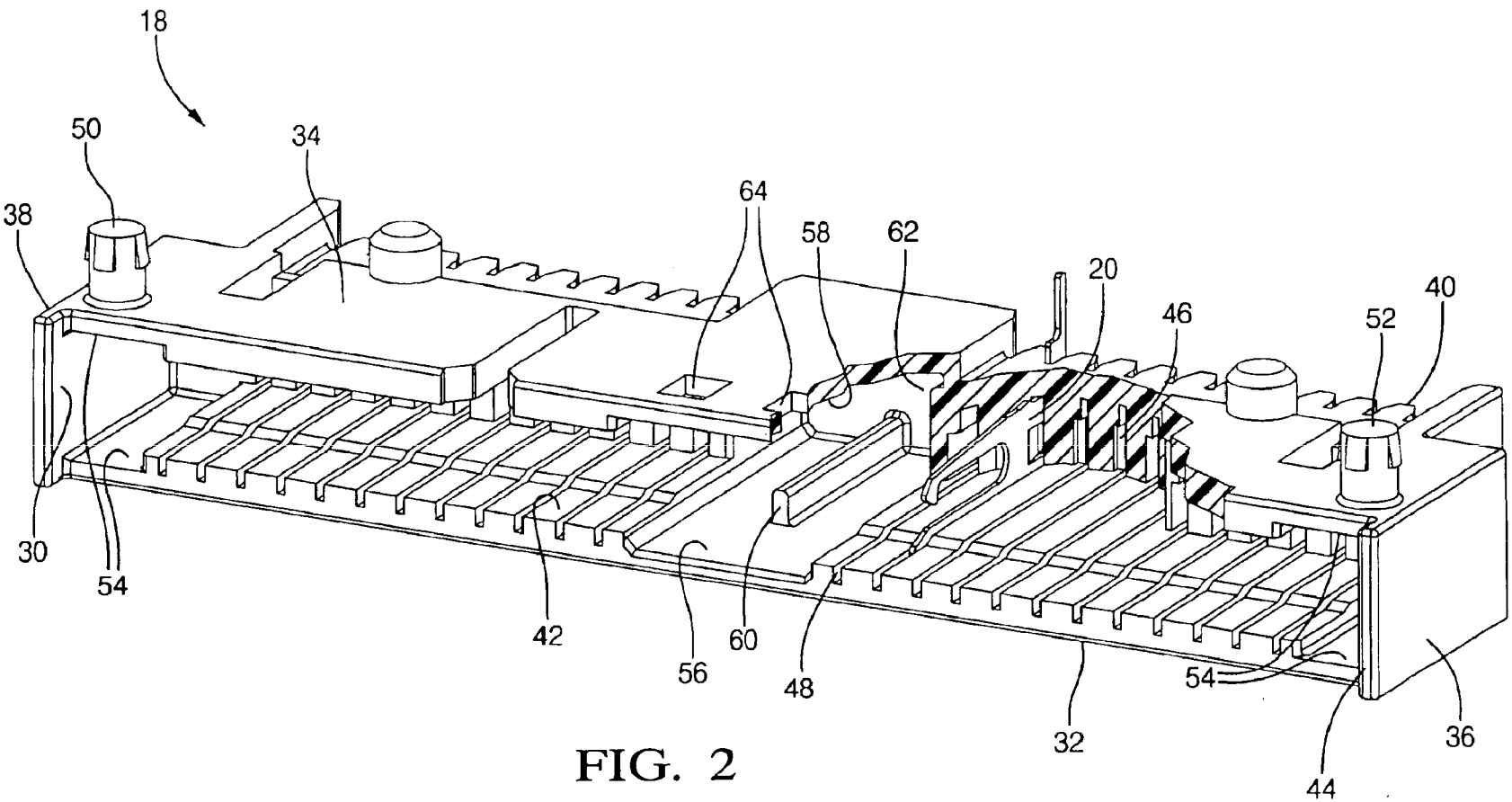
FIG. 2 is a perspective cross-sectional view of one aspect of the present invention.

It should be noted that connector assembly 10 has an axis that extends in the direction of insertion of the flat cable assembly 14 into the header assembly 12. Insulative housing 18 comprises a non-conducting material and has a generally rectangular, elongate shape. As shown in FIG. 2, housing 18 includes cable-assembly-receiving cavity 30 defined by top wall 32, bottom wall 34, first and second side walls 36, 38, and front wall 40. Receiving cavity 30 includes opening 42 at mating face 44 opposite front wall 40 for receiving flat cable assembly 14. A plurality of terminal receiving passageways 46 extend through front wall 40 of housing 18. Each passageway 46 is sized to frictionally hold a terminal 20.

Top wall 32 of housing 18 includes a plurality of axially extending second contact arm receiving slots 48, each slot 48 being aligned with, and in communication with, one of the terminal receiving passageways 46. Housing 18 includes first and second attachment posts 50, 52 for attaching housing 18 to circuit board 300 (shown on FIG. 1). Axially extending alignment grooves 54 are formed in top wall 32 and bottom wall 34 adjacent to side walls 36, 38. Axially extending alignment groove 56 is formed in the center of top wall 32 and axially extending alignment groove 58 is formed in the center of bottom wall 34. Axially extending alignment rib 60 is formed in alignment groove 58 formed in top wall 32. Front wall 40 includes axially extending alignment socket 62 formed therein. Bottom wall 34 includes locking tab receiving sockets 64 formed therein.

Figure 3:
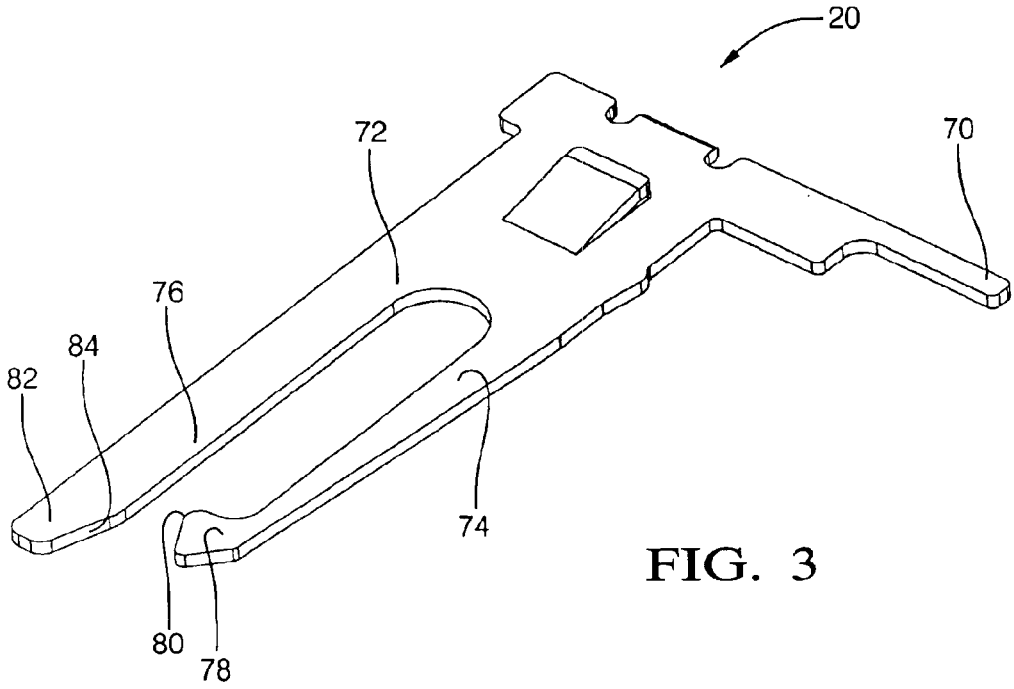
FIG. 3 is a perspective view of a terminal according to the present invention.

Terminals 20 are preferably made from a sheet of an electrically conductive material such as metal or metal alloy. As shown in FIG. 3, terminal 20 includes first end portion 70 and second end portion 72. Second end portion 72 includes deflectable first contact arm 74 and second contact arm 76. First and second contact arms 74, 76 extend at a substantially right angle from first end portion 70. First and second contact arms 74, 76 are generally parallel with each other. First contact arm 74 includes end portion 78 having a J-shape with a hook portion 80 of the "J" facing generally toward second contact arm 76 for contacting flexible flat cable 26. Each second contact arm 76 includes distal end portion 82 having angled surface 84 that faces generally toward first contact arm 74.

Figure 4:
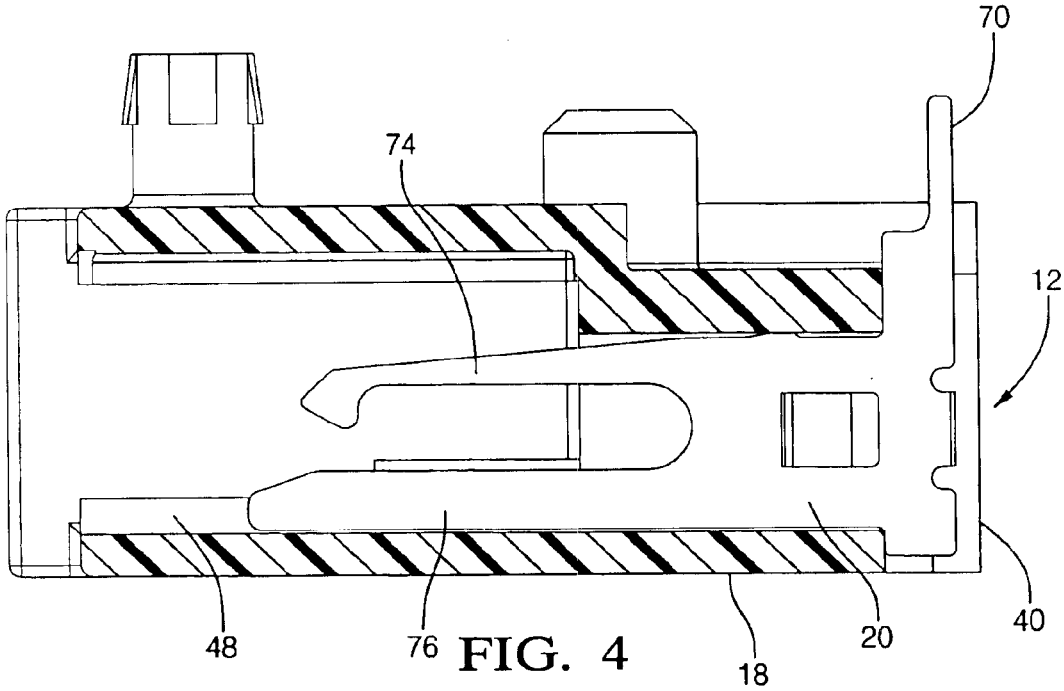
FIG. 4 is a cross-sectional view of another aspect of the present invention.

As shown in FIGS. 2 and 4, header assembly 12 includes each of plurality of terminals 20 mounted within one of the plurality of passageways 46 forming generally parallel rows of first and second contact arms 74, 76 within receiving cavity 30. First end portions 70 protrude outside housing 18 for connection to circuit board 300. Second contact arms 76 are partially disposed in second contact arm receiving slots 48.

Figures 5, 6, 7:
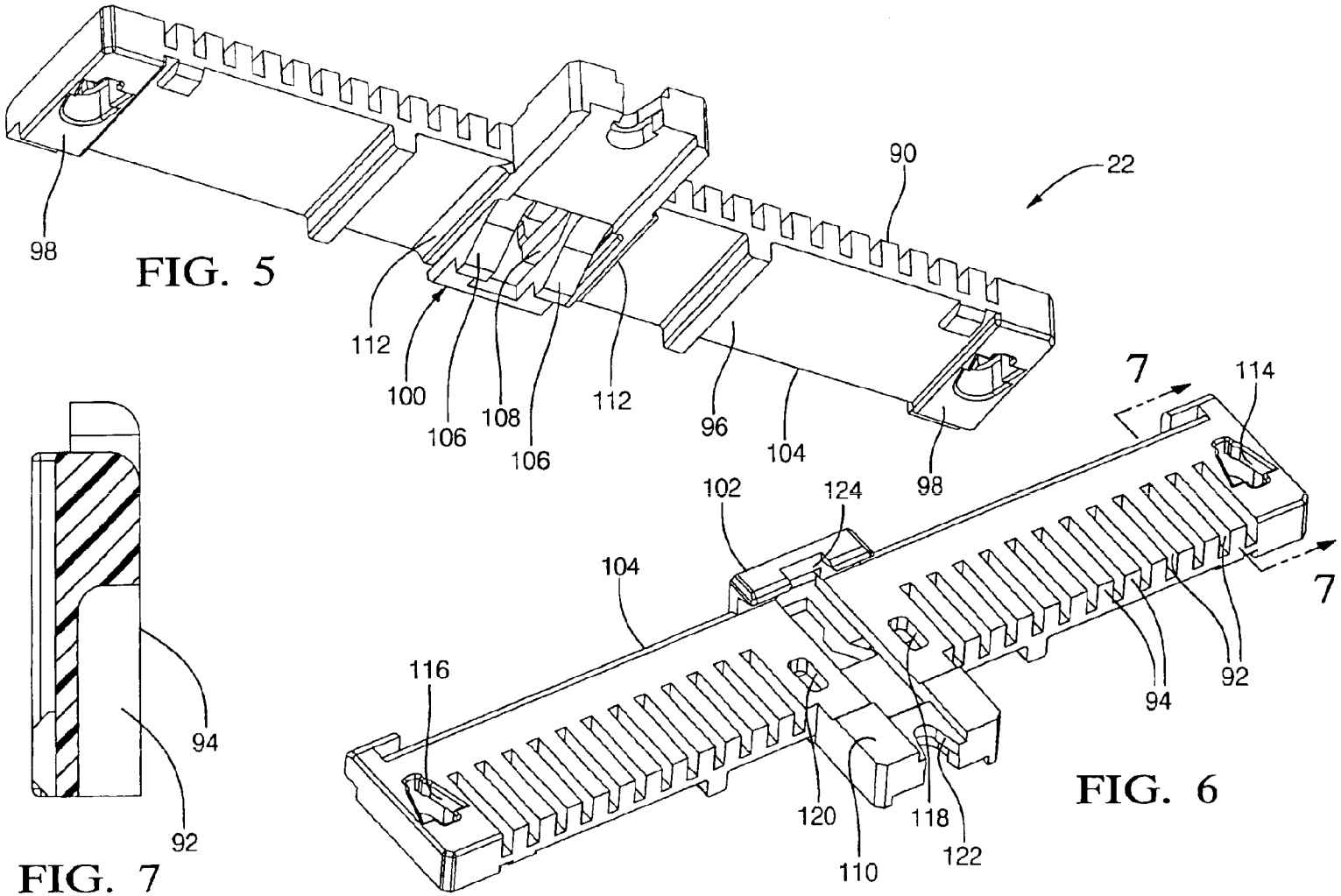
FIG. 5 is a perspective view of a slide member according to the present invention.
FIG. 6 is another perspective view of the slide member according to the present invention.
FIG. 7 is a cross-sectional view taken at line 7—7 of FIG. 6.

Slide member 22 comprises a non-conducting material. As shown in FIGS. 5–7, slide member 22 has an elongate shape adapted to be inserted into receiving cavity 30. Slide member 22 includes first side 90 for contacting flexible flat cable 26. A plurality of axially extending first contact arm receiving slots or passageways 92 are formed in first side 90 extending to forward facing mating face 94. Each slot 92 is for receiving one of the first contact arms 74 when flat cable assembly 14 is connected with header assembly 12. Slide member 22 includes second side 96 opposite first side 90. Axially extending alignment ribs 98 are formed along ends of second side 96 of slide member 22. Deflectable locking tab 100 extends from second side 96 of slide member 22. Distal end 102 of locking tab 100 extends slightly beyond rearward face 104. Locking tab 100 includes nibs 106 for engaging locking tab receiving sockets 64. It should be noted that one or more locking tab could be located on wedge member 24 instead of, or in addition to, slide member 22. Secondary lock receiving slot 108 is formed under locking tab 100. Nose portion 110 extends forwardly from mating face 94. Axially extending alignment rib 112 extends from second side 96 along nose portion 110. First and second locating post receiving apertures or sockets 114, 116 extend through slide member 22, one socket being formed near each end of slide member 22. Each locating post receiving socket 114, 116 has a V-shape. First and second staking post receiving sockets 118, 120 are formed in first side 90. A V-shaped attachment slot 122 is formed in a forward portion of nose portion 110. End stop 124 is formed at rearward face 104.

Figure 8:
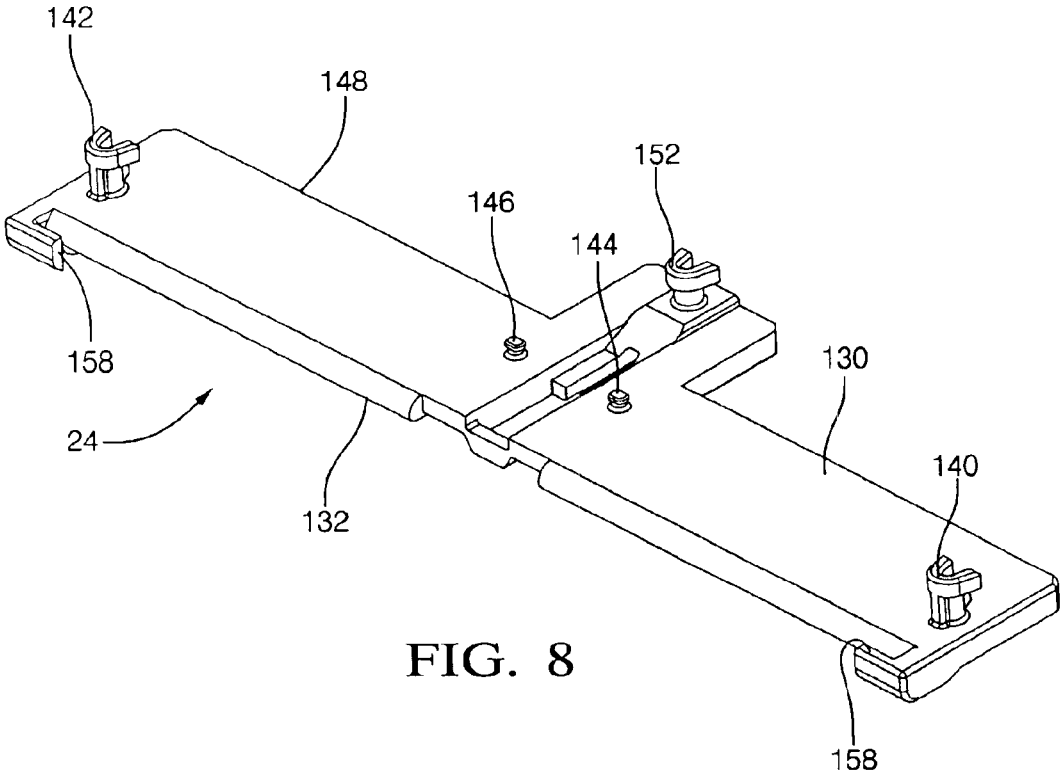
FIG. 8 is a perspective view of a wedge member according to the present invention.
Figure 9:
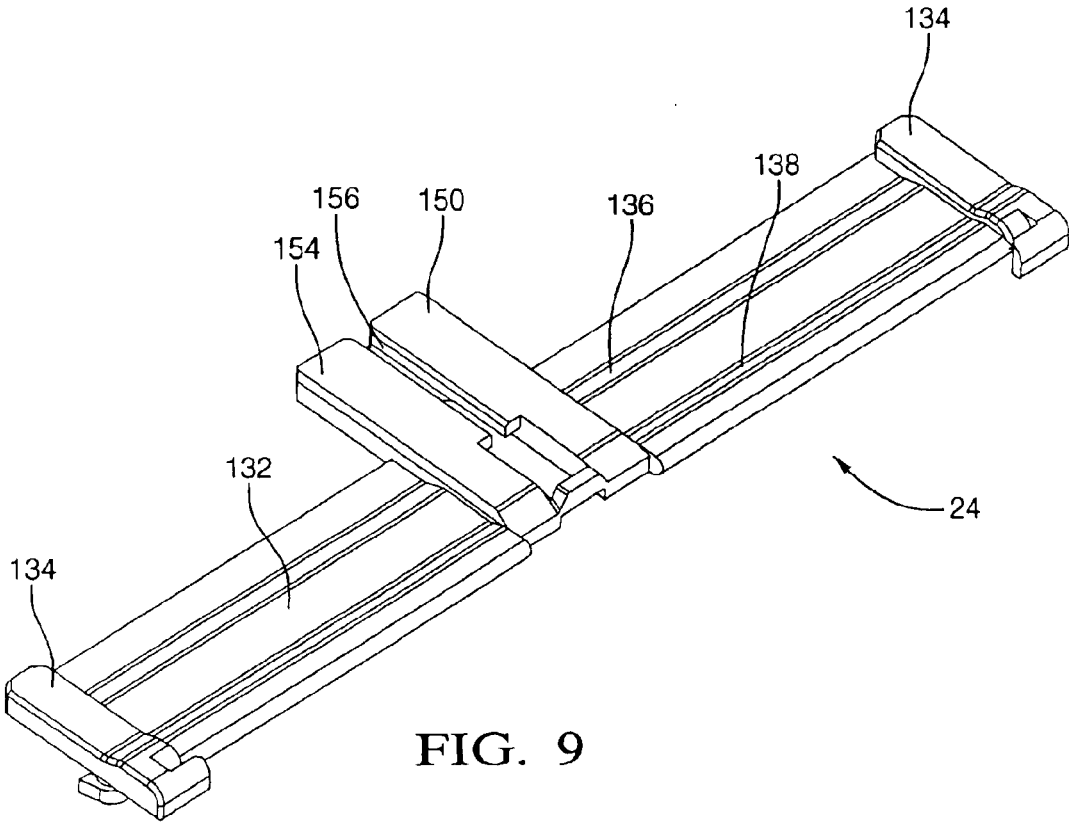
FIG. 9 is another perspective view of the wedge member of the present invention.

Wedge member 24 is made from a non-conducting material. As shown in FIGS. 8 and 9, wedge member 24 has an elongate shape adapted to be inserted into receiving cavity 30 along with slide member 22 and flexible flat cable 26. Wedge member 24 includes first side 130 for contacting flexible flat cable 26. Wedge member 24 includes second side 132 opposite first side 130. Axially extending alignment ribs 134 are formed along each end of second side 132 of wedge member 24. Second side 132 includes first and a second inclined portion 136, 138 for engaging the row of second contact arms 76. First and second locating posts 140, 142 extend from the first side 130 of the wedge member 24, one locating post being positioned near each end of the wedge member 24. Obviously, each locating post 140, 142 can be located on either the slide member 22 or the wedge member 24 and the corresponding locating post receiving socket 114, 116 located on the other of the slide member 22 or the wedge member 24. First and second staking posts 144, 146 extend from the first side 130. The wedge member 24 has a mating face 148. A nose portion 150 extends forwardly from the mating face 148. An attachment post 152 extends from the first side 130 of the nose portion 150. An axially extending alignment rib 154 extends from the second side 132 along the nose portion 150. An axially extending alignment groove 156 extends along the center of the second side 132. The wedge member 24 includes a pair of retaining tabs 158 forming slots for routing the flexible flat cable 26.

Figure 10:
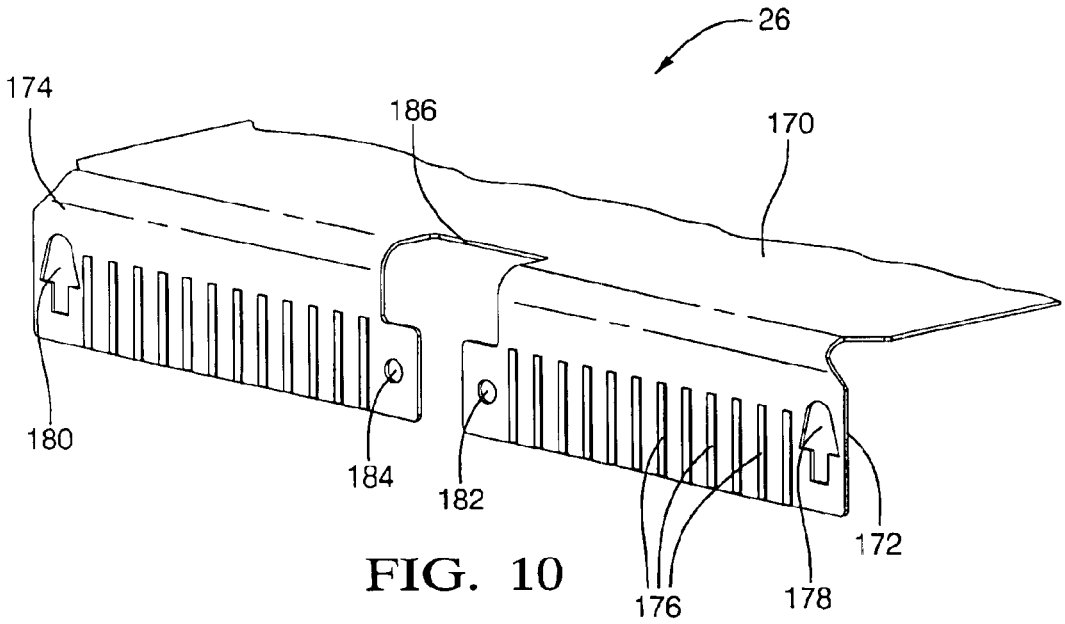
FIG. 10 is a perspective view of a flexible flat cable according to the present invention.

As shown in FIG. 10, the flexible flat cable 26 has a first side 170 and an opposing second side 172. The flexible flat cable 26 has a connecting end portion 174 with exposed portions of conductive circuit traces forming electrically conductive contact pads 176 on the first side 170. First and second locating holes 178, 180 are formed in the flexible flat cable 26. The locating holes 178, 180 are positioned to align with the locating posts 142, 140 that extend from the first side 130 of the wedge member 24. First and second staking post receiving holes 182, 184 are formed in the flexible flat cable 26. The staking post receiving holes 182, 184 are positioned to align with the pair of staking posts 146, 144 that extend from the first side 130 of the wedge member 24. The flexible flat cable 26 has a cut-out portion 186 at a center of the connecting end portion 174 to provide clearance for the attachment post 152, the end stop 124, and the secondary lock member 16.

Figure 11:
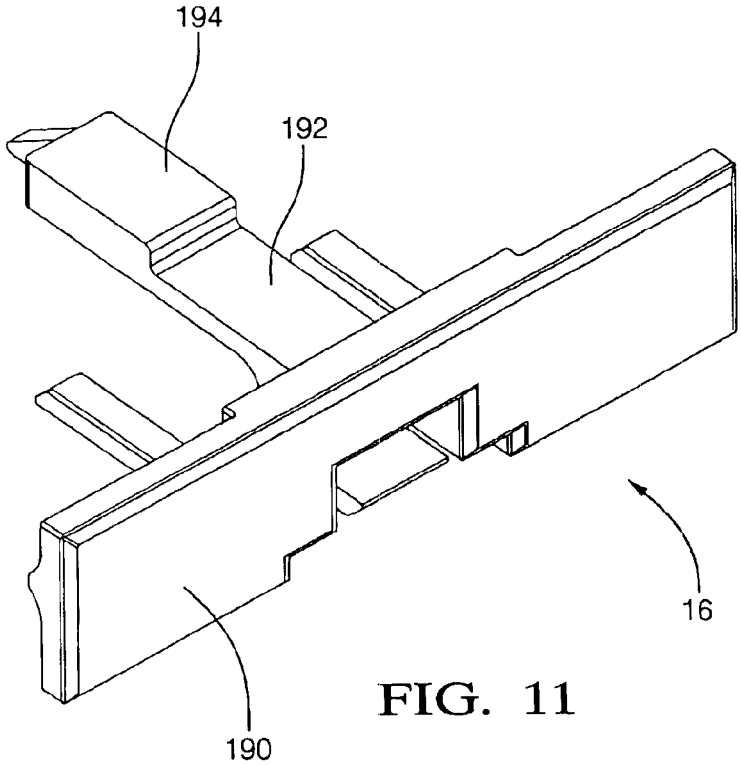
FIG. 11 is a perspective view of a secondary lock member according to the present invention.

As shown in FIG. 11, the secondary lock member 16 includes an end tab 190 and a locking rod 192 extending perpendicularly from the end tab 190. An end portion of the locking rod 192 includes a raised platform 194.

Figure 12:
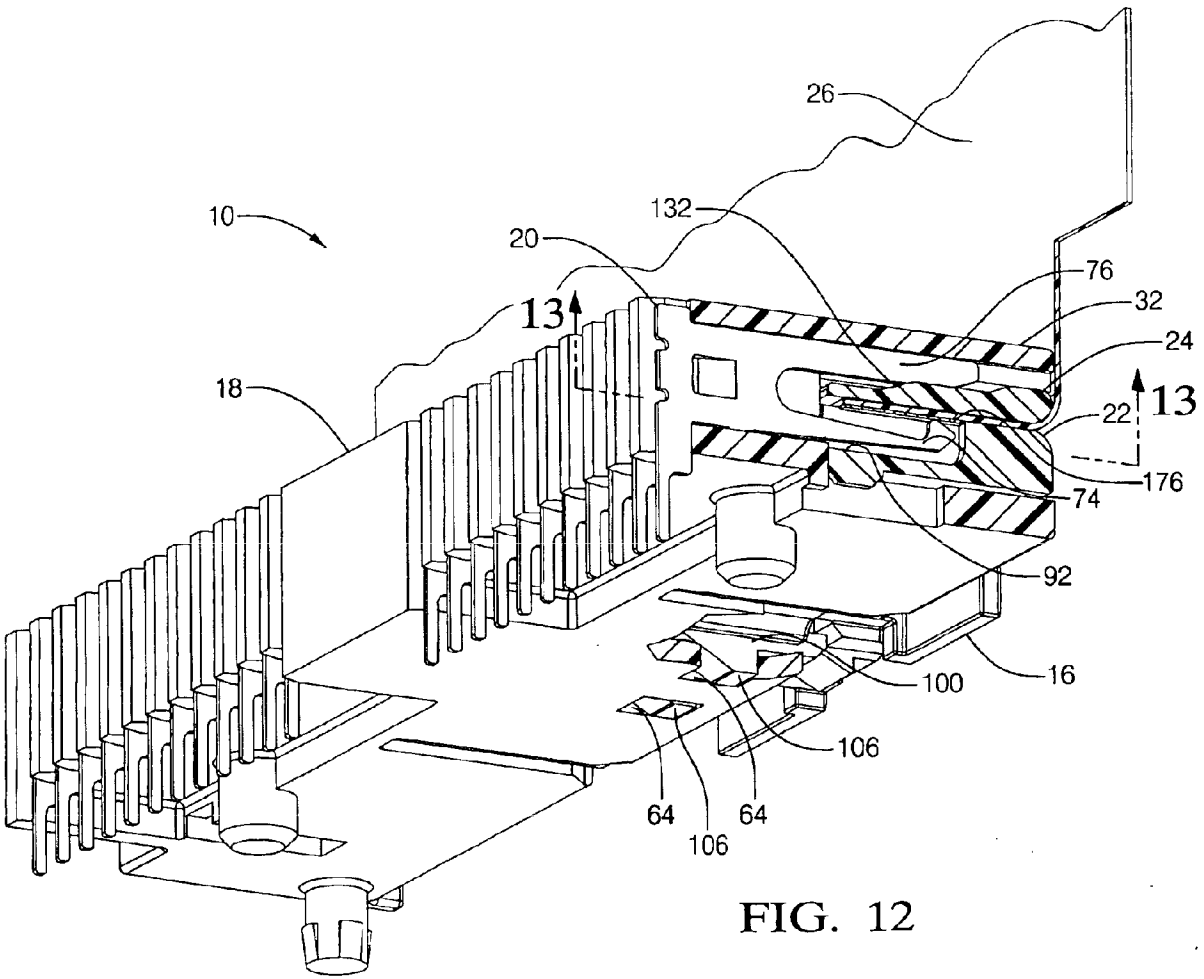
FIG. 12 is a perspective cross-sectional view of yet another aspect of the present invention.
Figure 13:
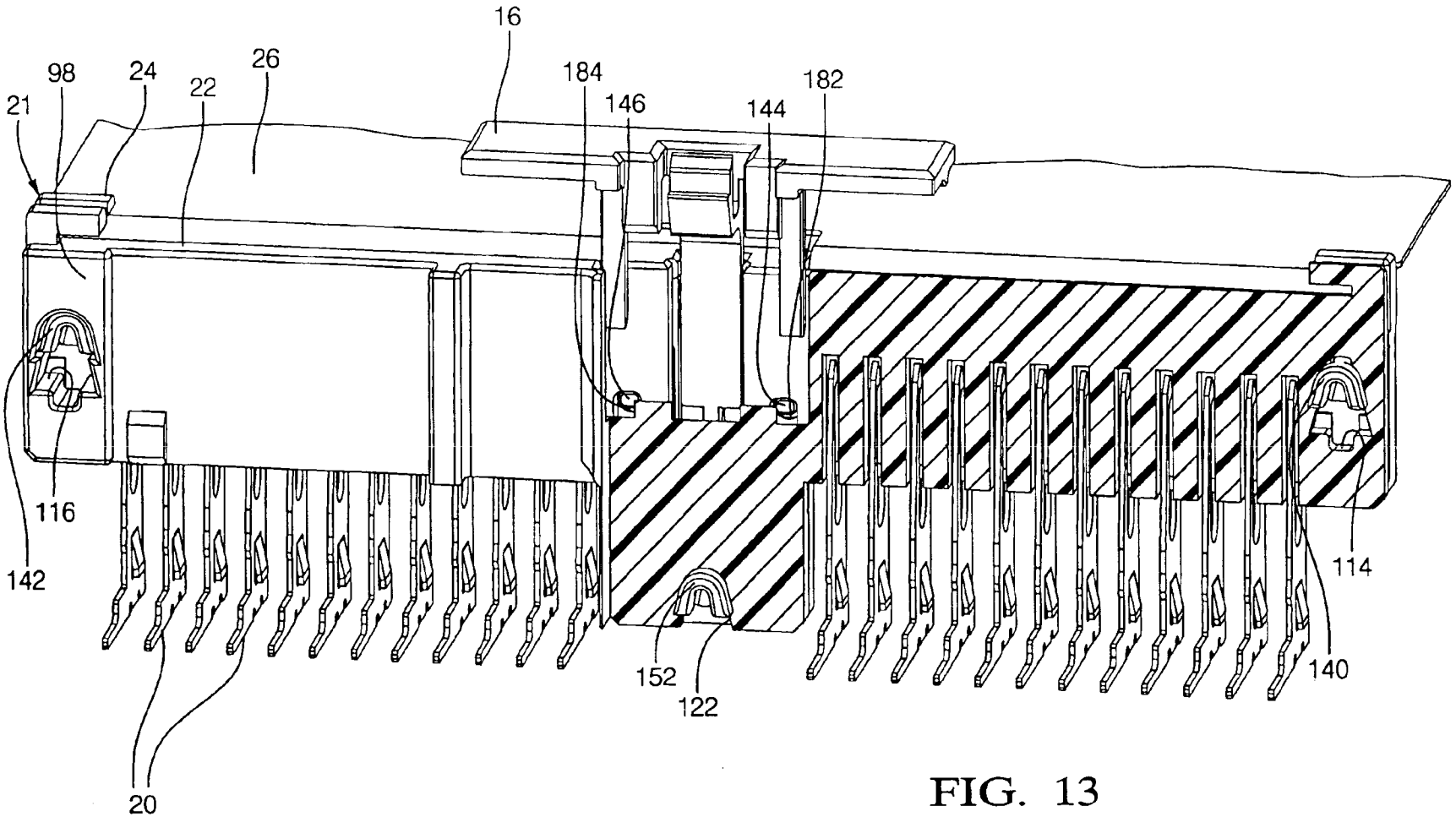
FIG. 13 is a perspective cross-sectional view taken at line 13—13 of FIG. 12.

The flat cable assembly 14 includes the connecting end portion 174 of the flexible flat cable 26 positioned between the slide member 22 and wedge member 24. The first side 170 of the flexible flat cable 26 is positioned facing the first side 90 of the slide member 22. As shown in FIGS. 12 and 13, the contact pads 176 are aligned with and face the first contact arm receiving slots 92 on the slide member 22. The slots 92 provide access for each of the terminal 20 first contact arms 74 to electrically contact the contact pads 176. Wide contact pads (not shown) may extend across a plurality of slots 92 enabling current flowing through wide contact pads to flow through a plurality of terminals 20. Each locating post 140, 142 of the wedge member 24 extends through a respective locating hole 180, 178 of the flexible flat cable 26 into a respective locating post receiving socket 114, 116 of the slide member 22 assuring that the first contact arm receiving slots 92 are properly aligned with the contact pads 176. Each staking post 144, 146 of the wedge member 24 extends through a respective staking post receiving hole 184, 182 of the flexible flat cable 26 into a respective staking post receiving socket 118, 120 of the slide member 22. The attachment post 152 of the wedge member 24 extends into the attachment slot 122 of the slide member 22. The locating posts 140, 142 and attachment post 152 are wedged into the respective bottoms of each of the "V"s of the sockets 114, 116 and the attachment slot 122 providing an interference fit clamping the connecting end portion 174 of the flexible flat cable 26 between the slide member 22 and the wedge member 24. The slide member 22 substantially covers the contact pads 176 on the connecting end portion 174 of the flexible flat cable 26. The openings formed by the slots 92 expose the contact pads 176 for contact with the first contact arm 74 of the terminals 20.

The flat cable assembly 14 is connected to the header assembly 12 by inserting the flat cable assembly 14 into the receiving cavity 30 of the housing 18. As the flat cable assembly 14 is inserted into the receiving cavity 30, the alignment ribs 98, 112 of the slide member 22, the alignment ribs 134, 154 of the wedge member 24, and the alignment groove 156 of the wedge member 24 engage the corresponding alignment grooves 54, 56, 58 and the alignment rib 60 of the housing 18 assuring proper alignment between the terminals 20 and the first contact arm receiving slots 92. The nose portions 110, 150 of the slide member 22 and the wedge member 24 are received by the alignment socket 62. As the flat cable assembly 14 is further inserted into the receiving cavity 30 each of the first contact arms 74 is received in one of the first contact arm receiving slots 92. The second side 132 of the wedge member 24 abuts against the row of second contact arms 76, pressing the contact pads 176 of the flexible flat cable 26 against the first contact arms 74 making electrical connection between the terminals 20 and the contact pads 176. The nibs 106 of the locking tab 100 releasingly engage the locking tab receiving sockets 64 for releasably retaining the flat cable assembly 14 within the receiving cavity 30 of the housing 18.

In an exemplary embodiment, a secondary lock member 16 is inserted into the secondary lock receiving slot 108 formed under the locking tab 100 maintaining the locking tab 100 in a locked position and preventing disconnection of the flexible flat cable 26 from the terminals 20.

This invention has been described with reference to an exemplary embodiment and modifications thereto. Further modifications and alterations may occur to others upon reading and understanding the specification. It is intended to include all such modifications and alterations insofar as they come within the scope of the invention. For example, the locking tab 100 is incorporated in the slide member 22, but can alternatively be incorporated in the wedge member 24. Or, for example, locating posts 140, 142 are integrally incorporated in the wedge member 24, but the locating posts can alternatively be incorporated in the slide member 22. Obviously, distinct locating posts could also be utilized rather than integrally formed posts.

Having thus described the invention, what is claimed is:

1. A connector assembly comprising:

a first connector comprising an insulative housing having a cavity disposed therein, said first connector further comprising a plurality of conductive terminals each having a first end portion and a second end portion, said second end portion including a first contact arm and a second contact arm, each of said plurality of terminals being mounted within said housing, each of said second end portions extending into said cavity forming generally parallel rows of first and second contact arms;

a flexible flat cable including an end portion having exposed conductive portions along a surface thereof; and a second connector comprising an insulative housing, said end portion of said flexible flat cable being clamped inside said second connector housing, said second connector housing having a plurality of openings for providing access to said conductive portions, wherein said second connector and said end portion of said flexible flat cable being received in said cavity, each of said first contact arms extending into one of said openings, said second connector abutting said row of second contact arms pressing said conductive portions against said first contact arms making an electrical connection between said terminals and said conductive portions.

2. The connector assembly of claim 1, wherein said first connector includes a locking tab receiving socket and said second connector includes a deflectable locking tab for releasably engaging said locking tab receiving socket for releasably retaining said second connector within said first connector.

3. The connector assembly of claim 2, further comprising a secondary lock member including a locking rod, said locking tab having a first slot for receiving said locking rod for maintaining said locking tab in a locked position.

4. The connector assembly of claim 1, wherein said conductive portions being disposed on a first side of said flexible flat cable, said second connector comprising a first connector half and a second connector half, said first connector half being disposed along said first side of said flexible flat cable, said second connector half being disposed along an opposing second side of said flexible flat cable, said first connector half being affixed to said second connector half.

5. The connector assembly of claim 4, wherein each of said openings in said second connector comprise a second slot formed in a side of said first connector half, each said second slot being positioned adjacent one of said conductive portions.

6. The connector assembly of claim 5, wherein said second connector includes at least two locating posts extending through said flexible flat cable for locating said flexible flat cable.

7. The connector assembly of claim 6, wherein said second connector includes at least two sockets for receiving said locating posts for aligning said first connector half with said second connector half.

8. The connector assembly of claim 1, wherein said first connector and said second connector include an alignment groove and the other of said first connector and said second connector include an alignment rib for engaging with said alignment groove.

9. The connector assembly of claim 1, wherein said first connector includes a plurality of walls defining said cavity, a plurality of parallel third slots being formed in one of said walls extending in a direction of insertion of said second connector into said cavity, each of said second contact arms being partially disposed within a respective one of said third slots.

10. The connector assembly of claim 1, wherein said first contact arm of said terminal is deflectable.

11. The connector assembly of claim 10, wherein said first contact arm and said second contact arm being generally parallel with each other, said first contact arm including a J-shaped end portion, the hook portion of said "J" extending generally toward said second contact arm for contacting said conductive portions.

12. A connector assembly comprising:

a flat cable assembly comprising a flexible flat cable member, said flexible flat cable member having exposed conductive contact pads along a first cable surface thereof, said flat cable assembly further comprising an insulative slide member and an insulative wedge member, said slide member having a plurality of first slots formed therein, said flexible flat cable member being secured between said slide member and said wedge member, said contact pads facing said first slots;

a connector comprising an insulative housing having a cavity disposed therein, a plurality of terminal receiving passageways being formed in said housing; and a plurality of conductive terminals each having a first end portion and a second end portion, each said second end portion including a deflectable first contact arm and a second contact arm, each of said plurality of terminals being mounted within a respective one of said terminal receiving passageways, said second end portions extending into said cavity forming generally parallel rows of first and second contact arms, said first end portions extending outside said housing;

wherein said flat cable assembly is received in said cavity, each of said first contact arms is received in one of said first slots, said wedge member abutting said row of second contact arms pressing said contact pads of said flexible flat cable member against said first contact arms making an electrical connection between said terminals and said contact pads.

13. The connector assembly of claim 12, wherein said housing includes a locking tab receiving socket and one of said slide member and said wedge member includes a deflectable locking tab for releasably engaging said locking tab receiving socket for releasably retaining said flat cable assembly within said housing.

14. The connector assembly of claim 13, further comprising a secondary lock member including a locking rod, said locking tab having a second slot for receiving said locking rod for maintaining said locking tab in a locked position.

15. The connector assembly of claim 12, wherein said flexible flat cable member has a locating hole formed therein, wherein one of said slide member and said wedge member includes a locating post, the other of said slide member or said wedge member including a locating post receiving socket, said locating post extending through said locating hole and further extending into said locating post receiving socket.

16. The connector assembly of claim 15, wherein said wedge member has an angled surface engageable with said second row of contact arms for guiding said flexible flat cable member toward said first row of contact arms as said flat cable assembly is inserted into said cavity.

17. The connector assembly of claim 16, wherein said housing and said flat cable assembly include a plurality of cooperating alignment grooves and alignment ribs.

18. The connector assembly of claim 17, wherein said first contact arm and said second contact arm are generally parallel with each other.

19. The connector assembly of claim 18, wherein said housing includes a plurality of parallel third slots disposed within said cavity, each said third slot being aligned with and in communication with a respective one of said terminal receiving passageways, each of said second contact arms being partially disposed within one of said third slots.

20. The connector assembly of claim 19, wherein said second contact arm includes an end having an angled surface, said angled surface facing generally toward said first contact arm.

21. The connector assembly of claim 12, wherein said housing includes a front wall portion, said front wall portion having an alignment socket formed therein, said wedge member and said slide member each including a nose portion, said nose portions being received in said alignment socket.

22. A connector assembly for providing an electrical interface to a flexible flat cable, the flexible flat cable including an end portion having exposed electrically conductive portions disposed along a surface thereof, said connector assembly comprising:

a first connector comprising an insulative housing having a cavity formed therein, said first connector further comprising a plurality of conductive terminals, each having a first end portion and a second end portion, said second end portion including a deflectable first contact arm and a second contact arm, each of said plurality of terminals being mounted within said housing forming generally parallel rows of first and second contact arms within said cavity, said first end portion protruding outside said housing; and a second connector comprising an insulative housing, the end portion of the flexible flat cable being clamped inside said second connector housing, said second connector housing having a plurality of openings for providing access to the conductive portions, wherein said second connector and the end portion of the flexible flat cable being received in said cavity, each of said first contact arms extending into one of said openings, said second connector abutting said row of second contact arms pressing the conductive portions against said first contact arms making an electrical connection between said terminals and the conductive portions.

23. The connector assembly of claim 22, wherein said first connector includes a locking tab receiving socket and said second connector includes a deflectable locking tab for releasably engaging said locking tab receiving socket for releasably retaining said second connector within said first connector.

24. The connector assembly of claim 23, further comprising a secondary lock member including a locking rod, said locking tab having a slot for receiving said locking rod.

* * * * *